US005202088A

United States Patent [19]

Genma et al.

[11] Patent Number: 5,202,088

[45] Date of Patent: Apr. 13, 1993

[54] FERRITIC HEAT-RESISTING CAST STEEL AND A PROCESS FOR MAKING THE SAME

[75] Inventors: Yoshikazu Genma; Shinji Katou, both of Aichi; Masami Suzuki, Okazaki; Shinya Mizuno; Tsutomu Sekiguchi, both of Toyota, all of Japan

[73] Assignee: Toyota Jidosha Kabushiki Kaisha, Toyota, Japan

[21] Appl. No.: 813,697

[22] Filed: Dec. 27, 1991

[30] Foreign Application Priority Data

Dec. 28, 1990 [JP] Japan ..... 2-417095
Jun. 27, 1991 [JP] Japan ..... 3-183235

[51] Int. Cl.[5] ..... C22C 38/22; C22C 38/24; C21D 6/00

[52] U.S. Cl. ..... 420/40; 420/69; 148/325; 148/538; 148/605

[58] Field of Search ..... 420/40, 69; 148/325, 148/538, 605

[56] References Cited

FOREIGN PATENT DOCUMENTS 57-73170 5/1982 Japan ..... 420/40
1159354 6/1989 Japan .

*Primary Examiner*—Deborah Yee
*Attorney, Agent, or Firm*—Oblon, Spivak, McClelland, Maier & Neustadt

[57] ABSTRACT

Ferritic heat-resisting cast steel, which intends to highten the applicability for use of the exhaust manifold of a vehicle engine without losing oxidation resistance, machinability and structural stability, containing, on a weight basis, 0.05 to 0.5% C, 1.0 to 2.0% Si, less than 0.6% Mn, less than 0.04% P, less than 0.04% S, less than 0.5% Ni, 10 to 20% Cr, 0.1 to 1.0% V, 0.5 to 1.0% Nb, 0.08 to 0.50% Mo, less than 0.01% W and 0.01 to 0.2% Ce, the balance of its composition being iron. Alternatively, it may contain 0.1 to 1.5% Mn and 0.01 to 0.2% S, and may further contain 0.01 to 0.2% Te and/or 0.01 to 0.3% Al. Further, it may contain 0.1 to 5.0% Co and/or 0.1 to 5.0% Ti. The cast steel is annealed at a temperature of 850° C. to 1000° C. for one to five hours.

9 Claims, 7 Drawing Sheets x400 x400

FERRITIC HEAT-RESISTING CAST STEEL AND A PROCESS FOR MAKING THE SAME

BACKGROUND OF THE INVENTION

1. Field of the Invention

This invention relates to ferritic heat-resisting cast steel, and more particularly, to heat-resisting cast steel which is suitable for use in making an exhaust manifold for an automobile engine, a turbine housing, or the like.

2. Description of the Prior Art

It was usual to employ high-Si nodular graphite cast iron, Niresist (or Ni-Resist), etc. for making an exhaust manifold or a turbine housing. The development of an automobile engine having a higher output and a lower fuel consumption has, however, given rise to a demand for materials having a higher level of heat resistance. High-Ni and high-Cr austenitic heat-resisting steels have been well known for their high heat-resistance, but have been too low in castability and machinability to be acceptable for the efficient manufacture of engine parts at a reasonable cost.

High-Cr ferritic heat-resisting cast steels have come to draw attention for their reasonably high castability and machinability. These steels, have, however, been found still unsatisfactory in heat resistance, since they show a sharp reduction in strength at temperatures over the range of 550° C. to 650° C. (see, for example, "Handbook of Stainless Steels", Nikkan Kogyo Shinbunsha, pp. 513–521, and "Gakujutsu Geppo" (Monthly Report on Sciences), Vol. 43, No. 1, pp. 18–22).

Improved ferritic heat-resisting cast steels have, therefore, been proposed. For example, Japanese Patent Laid-Open No. 159354/1989 has proposed ferritic heat-resisting cast steel containing basically 0.06 to 0.20% C, 0.3 to 1.0% Mn, 0.4 to 2.0% Si and 15 to 22% Cr, and further about 0.01 to 1.0% of another element providing improved heat resistance, such as Nb, V, Ni, Mo or W, all by weight. This steel has, however, a number of drawbacks. It contains W at the sacrifice of the oxidation resistance which is one of the great advantages of the ferritic heat-resisting cast steels in general. The relatively high proportion of manganese which it contains is likely to add to its hardness and thereby lower its machinability. The relatively high proportion of nickel which it may contain is likely to cause it to have a lower eutectic transformation temperature and thereby lack structural stability.

SUMMARY OF THE INVENTION

Under these circumstances, it is an object of this invention to provide ferritic heat-resisting cast steel which has an improved heat resistance, as well as high oxidation resistance, machinability and structural stability, and is, therefore, more suitable as a material for parts of the exhaust system of an automobile engine than any known material.

This object is attained by ferritic heat-resisting cast steel containing 0.05 to 0.5% C, 1.0 to 2.0% Si, less than 0.6% Mn, less than 0.04% P, less than 0.04% S, less than 0.5% Ni, 10 to 20% Cr, 0.10 to 1.0% V, 0.5 to 1.0% Nb, 0.08 to 0.5 0% Mo, less than 0.01% W and 0.01 to 0.2% Ce, the balance thereof being iron, all on a weight basis.

In the present invention, in order to prompt the deoxidation function of the molten steel, it may be preferable to determine the range of Mn of the above basic elements to 0.1 to 1.5%. In this case, since the machinability of the cast steel is decreased due to the higher content of Mn, it is preferable to determine S-content to a higher 0.01 to 0.2% and further if necessary to add the combination of 0.01 to 0.2 % Te and/or 0.01 to 0.3% Al. Further, in the present invention, in order to more increase the heat-resistance, it is preferable to add 0.1 to 5.0% Co and/or 0.1 to 5.0% Ti to the above basic elements. In this case too as well as the above, it may be preferable to determine the amount of Mn and S to be added to a little higher range of 0.1 to 1.5% and 0.01 to 0.20% respectively, further in addition to that, able to add 0.01 to 1.00% Al. And, as Al has the deoxidation effect, without combining it with Mn or S it may be added alone.

It is another object of this invention to provide a process for making an improved ferritic heat-resisting cast iron.

This object is attained by a process which comprises casting steel having compositions falling within the range as hereinabove defined, and annealing it at a temperature of 850° C. to 1000° C. for one to five hours.

Referring to each element and its proportion, the explanation of such limitation is as follows; carbon improves the strength and toughness of steel and the flowability (or castability) of molten steel, but does not produce any satisfactory result if its proportion is lower than 0.05%. If, on the other hand, its proportion exceeds 0.5%, it lowers the oxidation resistance of steel and also its eutectic transformation temperature and thereby it lowers the structural stability. Therefore, the steel of this invention contains 0.05 to 0.5 0% C.

Silicon improves the oxidation resistance of steel, raises its eutectic transformation temperature and is an effective deoxidizer, but does not produce any satisfactory result if its proportion is less than 1.0%. If, on the other hand, its proportion exceeds 2.0%, it lowers the toughness of steel at a low (or normal) temperature and its strength at a high temperature. Therefore, the steel of this invention contains 1.0 to 2.0 % Si.

Manganese is an element which forms pearlite, and is not very desirable for ferritic heat-resisting cast steel. Moreover, it increases the hardness of steel and thereby lowers its machinability. Therefore, the steel of this invention contains less than 0.6% Mn. On the other hand, if it is desired to determine a high amount of Mn in order to prompt deoxidation of the molten steel and increase the castability, S should be added to form MnS and improve the machinability. In this case, if Mn is less than 0.1%, the absolute amount of MnS lacks and if it exceeds 1.5% the balance with S is lost and lowers greatly the eutectic transformation temperature, so that the amount of it is determined to 0.1 to 1.5%.

The steel of this invention contains less than 0.04% P, since phosphorus is likely to promote the formation of heat cracks if its proportion is 0.04%, or above.

Since sulfur as well as phosphorus promotes not only the formation of heat cracks on steel but also the red shortness, it is preferable to hold less than 0.04%. On the other hand, in this case, it is combined with manganese to form MnS which improves the machinability of steel, the containing amount of it may be increased in accordance with the Mn containing amount. In this case, if the amount of S is less than 0.01%, the above heat cracks and red shortness is prompted to occur. Therefore, the steel of this invention contains 0.01 to 0.20%.

Chromium is a very important element which improves the oxidation resistance of steel and raises its eutectic transformation temperature, but does not produce any satisfactory result if its proportion is lower than 10%. If, on the other hand, its proportion exceeds 20%, it lowers the toughness of steel at a low temperature and produces coarse primary carbide crystals which lower the machinability of steel. Therefore, the steel of this invention contains 10 to 20% Cr.

Vanadium is also a very important element, as it greatly increases the eutectic transformation temperature of steel and is more likely to form carbide than chromium is, thereby restraining any primary chromium carbide from lowering the machinability of steel, but if its proportion is lower than 0.1%, it does not produce any satisfactory result. If its proportion exceeds 1.0%, however, it lowers the oxidation resistance of steel and its high-temperature strength. Therefore, the steel of this invention contains 0.1 to 1.0% V.

Niobium greatly increases the eutectic transformation temperature of steel, is more likely to form carbide than chromium is, thereby restraining any primary chromium carbide from lowering the machinability of steel, and inhibits the formation of any secondary carbide to thereby improve the oxidation resistance of steel, but does not produce any satisfactory result if its proportion is less than 0.5%. If its proportion exceeds 1.0%, however, it forms so large an amount of carbide that steel has too low a carbon content. Therefore, the steel of this invention contains 0.5 to 1.0% Nb.

Molybdenum improves the strength of steel and raises its eutectic transformation temperature, but does not produce any satisfactory result if its proportion is less than 0.08%. If its proportion exceeds 0.50%, however, it lowers the cold toughness of steel and its oxidation resistance. Therefore, the steel of this invention contains 0.08 to 0.50% Mo.

Tungsten has so high a vapor pressure as to destroy a dense chromium oxide film on steel, thereby lowering its oxidation resistance seriously, and also lowers its cold toughness. Therefore, the steel of this invention contains less than 0.01% W.

Cerium is an important element which contributes to forming very fine crystal grains and thereby improving the cold toughness of steel drastically, but if its proportion is less than 0.01%, it does not produce any satisfactory result. And, if its proportion exceeds 2.0%, however, it ceases to be effective to produce any fine crystal grains. Therefore, the steel of this invention contains 0.01 to 2.0%.

Te increases the machinability of the cast steel by adhering to MnS, but if the amount of it is less than 0.01 %, it does not produce any satisfactory result. On the other hand, if it exceeds 0.2%, the yield is decreased outstandingly. Therefore, the steel of this invention contains 0.01 to 0.2% Te.

Al as well as Te not only increases the machinability by adhering to MnS but also contributes to the increase of the eutectic transformation temperature and of the oxidation resistance to become an effective deoxidizer. On the other hand if it is contained less than 0.01%, it does not produce the sufficient effect, and if over 1.00%, it lowers the toughness at low temperature. Therefore, the steel of this invention contains 0.01 to 1.00% Al.

Co has an effect of increasing the strength at high temperature, but if it contains less than 0.1%, the effect is not sufficient, on the other hand if above 5.0%, the strength at high temperature is rather decreased and also the toughness is decreased. Therefore, the steel of this invention contains 0.1 to 5.0% Co.

Although Ti has the effect to increase the strength at high temperature, but if it contains less than 0.1%, the effect is not sufficient, on the other hand if above 5.0%, the toughness is decreased. Therefore, the steel of this invention contains 0.1 to 5.0% Ti.

The steel of this invention contains only a very small amount of tungsten, if any, and has, therefore, a satisfactorily high level of oxidation resistance. It has a high level of machinability, since it contains only a low proportion of manganese, or since if it contains a relatively high proportion of manganese, it contains also a relatively high proportion of sulfur. In the latter case, it may further contain tellurium or both tellurium and aluminum to acquire a still higher level of machinability. Moreover, the steel of this invention contains only a small amount of nickel and has, therefore, a sufficiently high eutectic transformation temperature to maintain a high level of structural stability. Further, by adding Co and Ti, the strength at high temperature is more improved. In addition to that, the annealing of the steel as cast improves its machinability to a further extent, as it causes the decomposition of martensite and the formation of a ferrite structure in which carbide is dispersed.

These and other features and advantages of this invention will become apparent from the following description and the accompanying drawings.

DETAILED DESCRIPTION OF THE INVENTION

The invention will now be described more specifically with reference to the drawings, and examples.

Alloy steels having different compositions were prepared by casting to provide examples to be used for defining the basic composition of steel according to this invention. They were made by adding different proportions of vanadium, nickel, manganese, cerium and tungsten to steel containing 0.20% C, 1.50% Si, not more than 0.020% P, not more than 0.020% S, 16.0% Cr, 0.70% Nb and 0.20% Mo, the balance thereof being iron. Examination was made of the effects which the alloying elements might have on various properties of steels.

Figure 7:
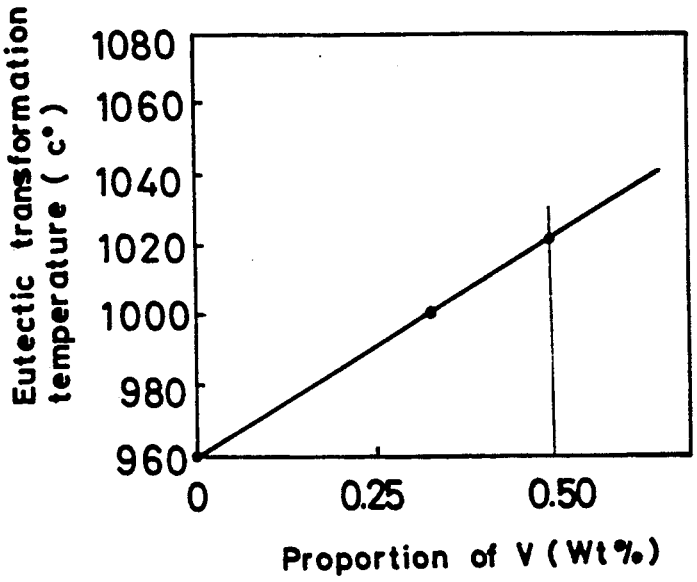
FIG. 7 is a graph showing the eutectic transformation temperatures of steels in relation to the vanadium contents thereof.

FIG. 7 shows the effects which vanadium has been found to exert on the eutectic transformation temperature of steel. It is confirmed that the eutectic transformation temperature of steel rises linearly with an increase in the proportion of vanadium. It is, therefore, obvious that the presence of appropriate amount desirably to ensure the formation of a stable ferritic structure without the formation of austenite.

Figure 8:
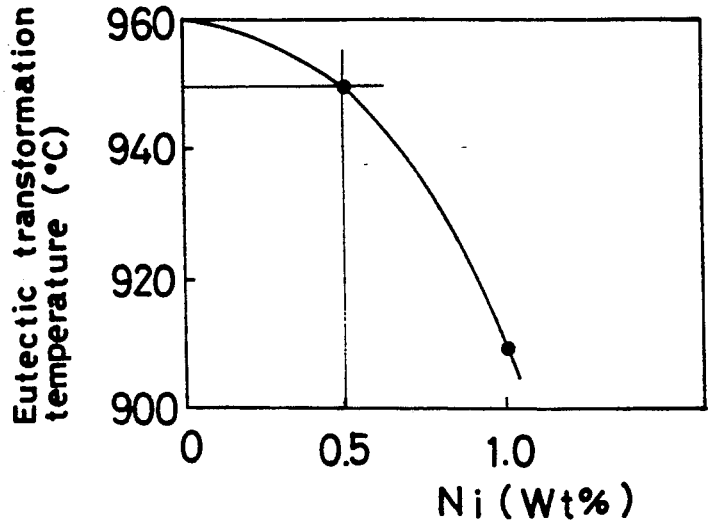
FIG. 8 is a graph showing the eutectic transformation temperature of steels in relation to the nickel contents thereof.

FIG. 8 shows the effects which nicklel has been found to exert on the eutectic transformation temperature of steel. It is confirmed that the eutectic transformation temperature of steel drops in a curve of secondary degree with an increase in the proportion of nickel, and that its drop is particularly sharp with steel containing 0.5% or more nickel. It is, therefore, obvious that the presence of less than 0.5% Ni is desirable.

Figure 9:
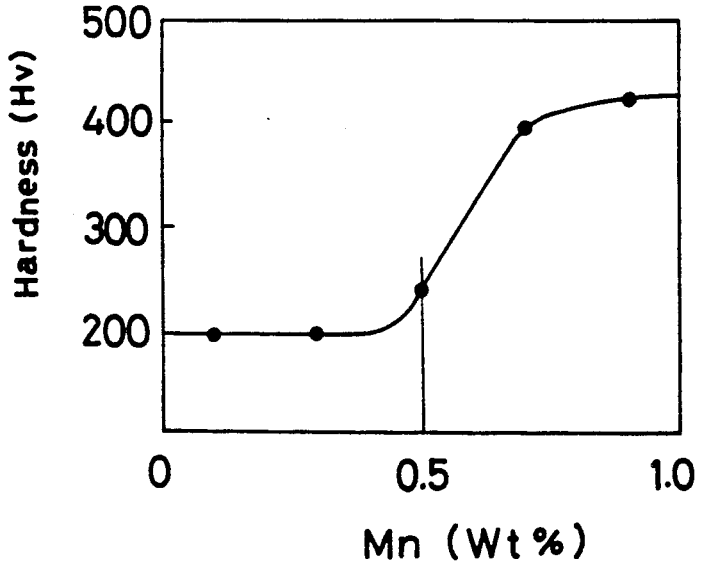
FIG. 9 is a graph showing the hardnesses of steels in relation to the manganese contents thereof.

FIG. 9 shows the effects which manganese has been found to exert on the hardness of steel as cast. The hardness of steel as cast shows a sharp increase with an increase in the proportion of manganese from 0.5 to 0.7%. It is, therefore, obvious that the manufacture of less than 0.6% Mn is desirably to ensure the manufacture of steel having a satisfactorily high level of machinability.

Figure 10:
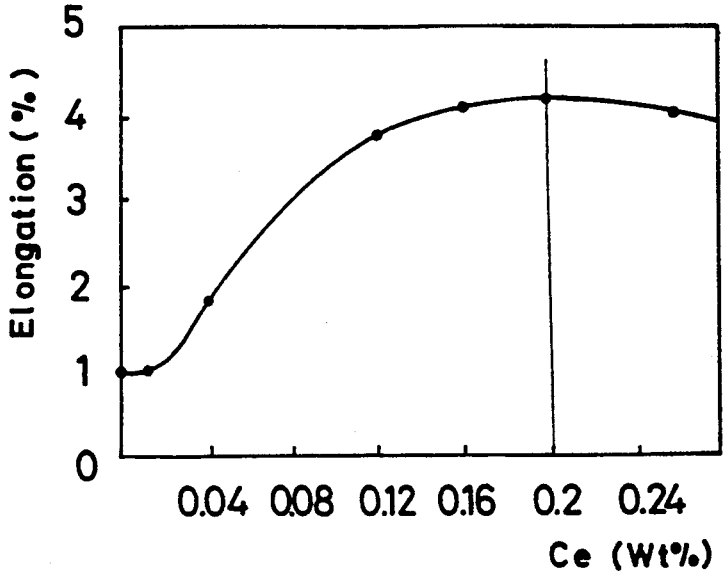
FIG. 10 is a graph showing the elongations of steels in relation to the cerium contents thereof.

FIG. 10 shows the effects which cerium has been found to exert on the elongation of steel at normal temperature. While steel containing less than about 0.01% Ce has a low and hardly varying value of elongation, steel containing about 0.01% Ce begins to show a sharp increase in elongation. Steel containing about 0.2% Ce shows the highest level of elongation and steel containing more cerium has a lower level of elongation. It is, therefore, obvious that the cerium range of 0.01 to 2.0% is desirable from an elongation standpoint.

Figure 11:
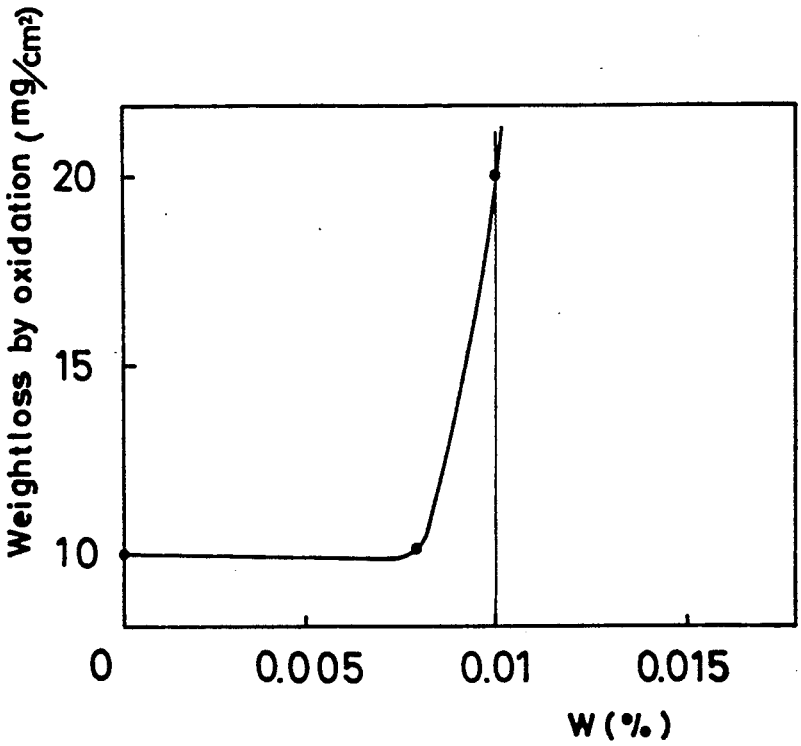
FIG. 11 is a graph showing the oxidation resistances of steels in relation to the tungsten contents thereof.

FIG. 11 shows the effects which tungsten has been found to exert on the weight loss by oxidation, or oxidation resistance of steel. Steel containing more than 0.008% W shows a sharp increase in weight loss by oxidation. It is, therefore, obvious that the limitation of the tungsten proportion to less than 0.01% is desirable to prevent any undesirable increase in weight loss by oxidation of steel, or any undesirable reduction in its oxidation resistance. The weight loss by oxidation of steel was determined by leaving it to stand at a temperature of 950° C. for 100 hours in the air.

Alloy steels having the basic compositions of 0.05% C, 1.1% Si, 0.3% Ms, 0.01% P, 0.01% S, 15.3%Cr, 0.10%V, 0.80% Nb, 0.31Mo, 0.005% W, 0.05% Ce and the balance thereof being iron were made by adding different proportions of Co and Ti. Examination was made of the effects which the alloying elements might have on tensile strength at high temperature. The examination was carried out at 950° C.

Figure 12:
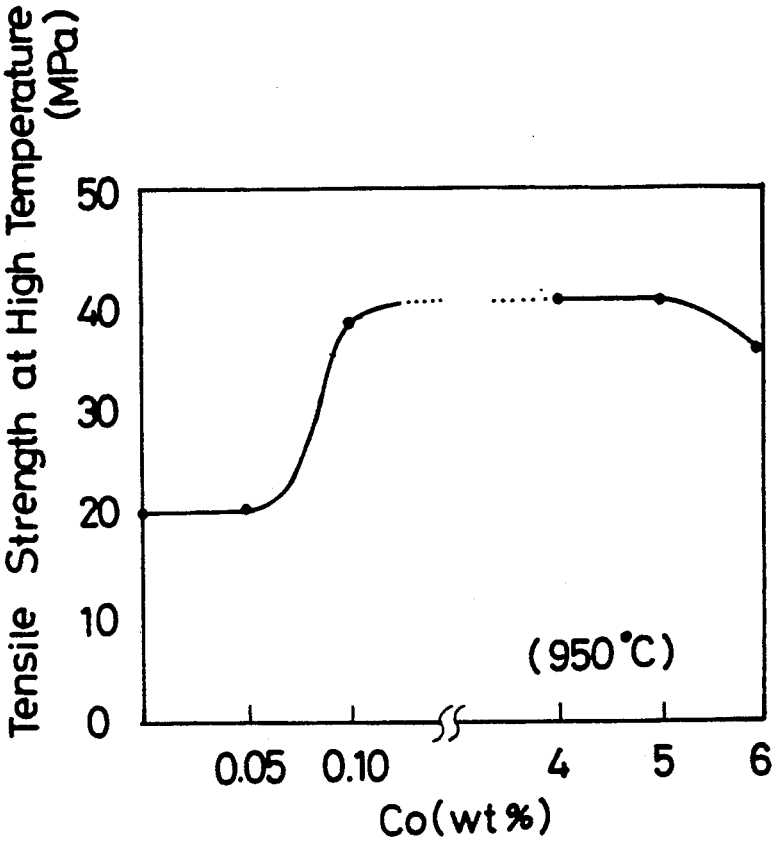
FIG. 12 is a graph showing the tensile strength in relation to the Co contents thereof.
Figure 13:
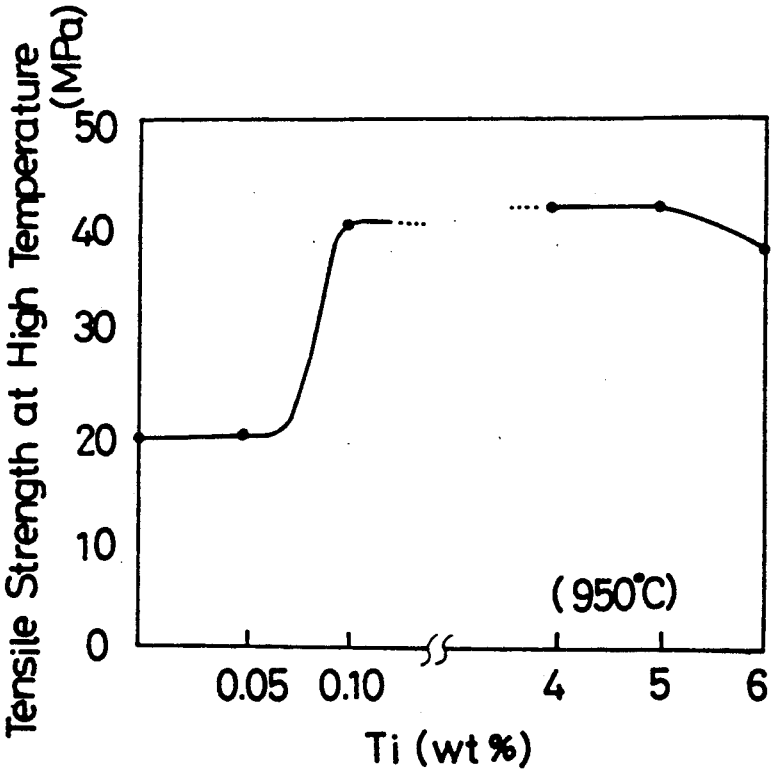
FIG. 13 is a graph showing the tensile strength in relation to the Ti contents thereof.

FIGS. 12 and 13 show the effects which Co and Ti have been found to exert on the tensile strength of the alloy steels. Thereby, it has been obvious that, although the tensile strength shows high value at more than 0.1% Co or Ti, it shows an inclination of decrease at over 5.0%, so that the stable tensile strength is obtained at 0.1 to 5.0% Co or It.

EXAMPLES AND COMPARATIVE EXAMPLES

Samples 1 to 16 and 21 and 33 of steel shown in Tables 1 and 2 embodying this invention and Comparative Samples 1 to 3 shown in Table 3 were prepared by casting. Each sample having the composition below was tested or examined for tensile strength at high temperature, hardness, microstructure, thermal fatigue, machinability, and oxidation resistance. The tensile strength at high temperature was conducted at 950° C. The thermal fatigue test by preparing a test-piece having a diameter of 10 mm and a length of 15 mm from each sample steel or material, fixing it at both ends thereof to hold it completely against movement, exposing it to a heat cycle between 250° C. and 950° C., and counting the number of the cycles which had been repeated until the testpiece broke. The machability test was conducted by drilling a hole in each testpiece to determine its resistance to the thrust and torgue produced by the drill as a measure of its cutting resistance, as well as measuring the amount of the wear which occurred to the drill. The oxidation resistance test was conducted by leaving each testpiece to stand at a temperature of 950° C. for 100 hours in the air, and measuring the resulting weight loss by oxidation thereof.

TABLE 1

| Sample No. | Chemical Composition (wt %) | | | | | | | | | | | | | |
|---|---|---|---|---|---|---|---|---|---|---|---|---|---|---|
| | C | Si | Mn | P | S | Ni | Cr | V | Nb | Mo | W | Ce | Te | Al |
| Sample of the invention | | | | | | | | | | | | | | |
| 1 | 0.19 | 1.46 | 0.49 | 0.017 | 0.011 | 0.01 | 15.9 | 0.46 | 0.70 | 0.17 | 0.001 | 0.036 | — | — |
| 2 | 0.19 | 1.49 | 0.70 | 0.017 | 0.10 | 0.01 | 16.1 | 0.46 | 0.69 | 0.18 | 0.001 | 0.031 | — | — |
| 3 | 0.20 | 1.47 | 0.75 | 0.018 | 0.10 | 0.01 | 16.2 | 0.46 | 0.70 | 0.18 | 0.001 | 0.027 | 0.027 | — |
| 4 | 0.20 | 1.53 | 0.71 | 0.018 | 0.09 | 0.01 | 16.3 | 0.47 | 0.72 | 0.16 | 0.001 | 0.032 | 0.062 | 0.15 |
| 5 | 0.18 | 1.37 | 0.42 | 0.017 | 0.012 | 0.01 | 16.5 | 0.45 | 0.69 | 0.17 | 0.001 | 0.028 | — | — |
| 6 | 0.18 | 1.45 | 0.55 | 0.018 | 0.053 | 0.01 | 16.3 | 0.46 | 0.69 | 0.17 | 0.001 | 0.10 | — | — |
| 7 | 0.25 | 1.29 | 0.45 | 0.017 | 0.012 | 0.01 | 15.3 | 0.38 | 0.60 | 0.10 | 0.001 | 0.17 | — | — |
| 8 | 0.26 | 1.31 | 0.55 | 0.018 | 0.055 | 0.01 | 15.6 | 0.38 | 0.61 | 0.10 | 0.001 | 0.023 | — | — |
| 9 | 0.05 | 1.0 | 0.3 | 0.01 | 0.02 | 0.3 | 15.0 | 0.5 | 0.60 | 0.50 | 0.005 | 0.050 | — | — |
| 10 | 0.10 | 2.0 | 0.4 | 0.01 | 0.03 | 0.01 | 18.6 | 0.1 | 0.75 | 0.30 | 0.005 | 0.06 | — | — |
| 11 | 0.14 | 2.0 | 0.3 | 0.01 | 0.03 | 0.2 | 20.0 | 0.5 | 0.50 | 0.10 | 0.006 | 0.08 | — | — |
| 12 | 0.30 | 1.5 | 0.3 | 0.01 | 0.02 | 0.4 | 15.0 | 1.0 | 0.80 | 0.20 | 0.006 | 0.01 | — | — |
| 13 | 0.40 | 1.60 | 0.49 | 0.01 | 0.01 | 0.2 | 15.9 | 0.46 | 0.80 | 0.17 | 0.005 | 0.040 | — | — |
| 14 | 0.50 | 1.8 | 0.4 | 0.01 | 0.03 | 0.3 | 10.0 | 0.1 | 1.00 | 0.10 | 0.005 | 0.10 | — | — |
| 15 | 0.31 | 1.9 | 0.4 | 0.01 | 0.02 | 0.01 | 14.8 | 0.3 | 0.62 | 0.10 | 0.005 | 0.05 | — | — |
| 16 | 0.30 | 2.0 | 0.4 | 0.01 | 0.02 | 0.01 | 15.0 | 0.3 | 0.62 | 0.10 | 0.006 | 0.05 | — | 0.48 |

TABLE 2

| Sample No. | Chemical Composition (wt %) | | | | | | | | | | | | | | |
|---|---|---|---|---|---|---|---|---|---|---|---|---|---|---|---|
| | C | Si | Mn | P | S | Ni | Cr | V | Nb | Mo | W | Ce | Co | Ti | Al |
| Sample of the invention | | | | | | | | | | | | | | | |
| 21 | 0.05 | 1.1 | 0.3 | 0.01 | 0.01 | 0.3 | 15.3 | 0.10 | 0.8 | 0.31 | 0.005 | 0.05 | 0.10 | — | 0.1 |
| 22 | 0.20 | 1.0 | 0.2 | 0.01 | 0.03 | 0.2 | 16.0 | 0.50 | 0.8 | 0.41 | 0.006 | 0.10 | 3.10 | — | 0.3 |
| 23 | 0.30 | 1.5 | 0.2 | 0.01 | 0.02 | 0.01 | 12.0 | 0.50 | 0.7 | 0.10 | 0.007 | 0.15 | 5.00 | — | 0.9 |
| 24 | 0.10 | 2.0 | 0.2 | 0.01 | 0.02 | 0.3 | 10.0 | 0.60 | 0.5 | 0.50 | 0.007 | 0.15 | — | 0.10 | 0.9 |
| 25 | 0.35 | 1.9 | 0.5 | 0.02 | 0.02 | 0.4 | 11.5 | 1.00 | 0.6 | 0.45 | 0.007 | 0.01 | — | 3.05 | 0.5 |
| 26 | 0.50 | 1.7 | 0.3 | 0.01 | 0.02 | 0.3 | 20.0 | 0.90 | 1.0 | 0.45 | 0.007 | 0.10 | — | 5.00 | 0.01 |
| 27 | 0.40 | 1.6 | 0.3 | 0.01 | 0.02 | 0.4 | 19.5 | 0.09 | 0.5 | 0.41 | 0.007 | 0.10 | 0.20 | 0.31 | 0.05 |
| 28 | 0.15 | 1.3 | 0.4 | 0.02 | 0.02 | 0.3 | 18.0 | 0.50 | 1.0 | 0.32 | 0.005 | 0.20 | 0.10 | 5.00 | 0.1 |
| 29 | 0.08 | 1.4 | 0.3 | 0.01 | 0.03 | 0.3 | 17.5 | 0.50 | 0.8 | 0.35 | 0.005 | 0.10 | 5.00 | 0.10 | 0.1 |
| 30 | 0.30 | 2.0 | 0.4 | 0.01 | 0.02 | 0.01 | 15.0 | 0.3 | 0.60 | 0.10 | 0.005 | 0.05 | 0.10 | 0.15 | — |
| 31 | 0.29 | 1.9 | 0.4 | 0.01 | 0.03 | 0.01 | 15.0 | 0.3 | 0.61 | 0.10 | 0.006 | 0.05 | 0.11 | 0.14 | 0.5 |
| 32 | 0.30 | 1.5 | 1.0 | 0.01 | 0.10 | 0.01 | 15.5 | 0.5 | 0.60 | 0.20 | 0.006 | 0.06 | 0.10 | 0.18 | 0.55 |
| 33 | 0.40 | 1.8 | 1.5 | 0.01 | 0.15 | 0.01 | 16.0 | 0.4 | 0.60 | 0.20 | 0.005 | 0.04 | 0.15 | 0.40 | 0.60 |

TABLE 3

| Comparative Example No. | Composition (Wt %) | | | | | | |
|---|---|---|---|---|---|---|---|
| | C | Si | Mn | P | S | Ni | Cr |
| 1 | 3.9 | 4.0 | 0.4 | — | — | — | — |
| 2 | 2.7 | 2.8 | 0.8 | — | — | 21.0 | 2.0 |
| 3 | 0.35 | 2.18 | 0.46 | 0.018 | 0.004 | 0.58 | 12.9 |

cf:
No. 1 is High-Si nodular graphite cast iron.
No. 2 is Niresit
No. 3 is JIS SCH1

Figure 1:
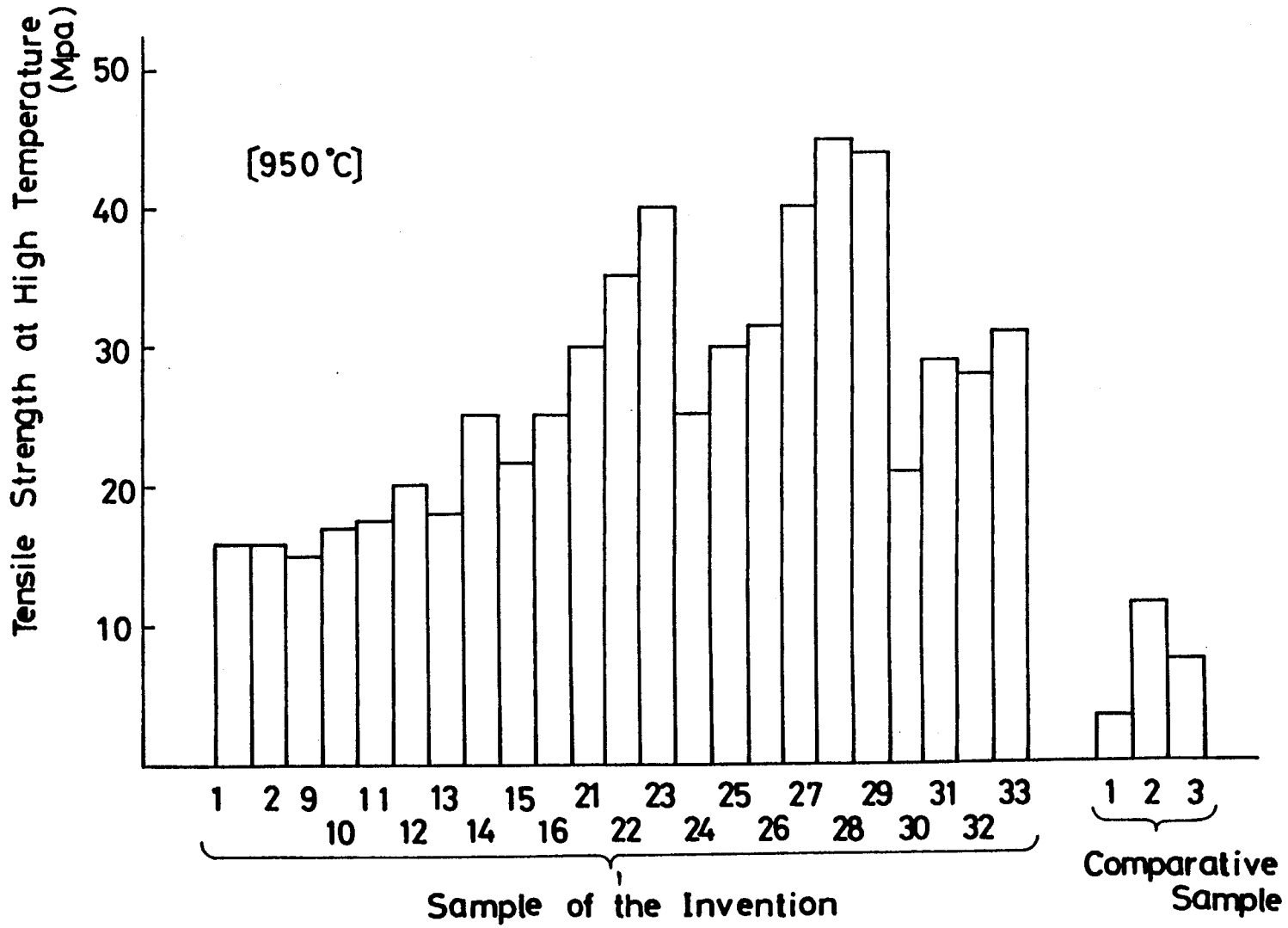
FIG. 1 is a graph showing the tensile strength of the ferritic heat-resisting cast steel in comparison with the comparative sample.

FIG. 1 shows the result of the tensile strength at high temperature test. By this figure, it has been obvious that each sample according to the present invention shows the property having an outstanding increase of tensile strength compared with the comparative example 1 (high-Si nodular graphite cast iron), and also compared with the comparative examples 2 (Niresist) and 3 (JIS SCH1). Further, of the samples of the present invention the ones containing Co and Ti show hight tensile strength compared with the ones containing no Co or Ti, which is increased in proportion to the increase of the containing amount thereof.

Table 4 shows the results of the hardness tests which were conducted on Samples 1 and 5 to 8 of this invention as cast and as annealed at 980° C. for three hours. As is obvious from TABLE 2, Samples 1, 5 and 6 of this invention were sufficiently low in hardness as cast, and showed a further reduction in hardness when annealed. Samples 7 and 8 of this invention containing more carbon than any other sample of this invention were higher in hardness as cast, but could be rendered satisfactorily soft by annealing.

TABLE 4

| Sample | Vickers hardness (Hv) | |
|---|---|---|
| | As cast | As annealed |
| Sample of the Invention | | |
| 1 | 240 | 195 |
| 5 | 230 | 198 |
| 6 | 236 | 194 |
| 7 | 367 | 220 |
| 8 | 352 | 216 |
| Comparative Sample | | |
| 1 | 220 | |
| 2 | 200 | |

Figure 2:
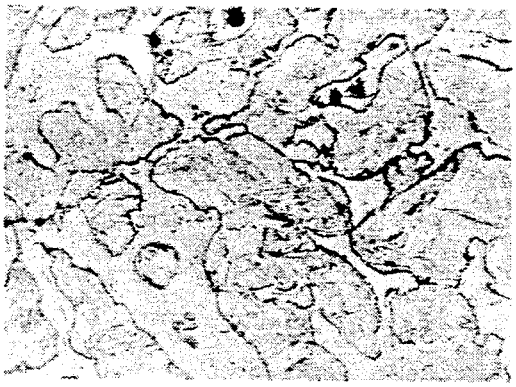
FIG. 2 is a photomicrograph showing the structure of ferritic heat-resisting cast steel embodying this invention and as cast.
Figure 3:
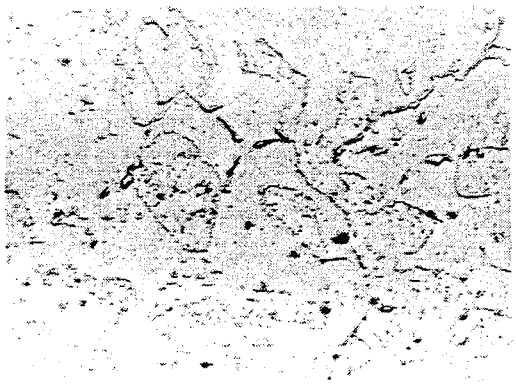
FIG. 3 is a photomicrograph showing the structure of the steel as annealed.

FIGS. 2 and 3 show the microstructures of Sample 1 of this invention as cast and as annealed, respectively. While FIG. 2 shows the presence of needle crystals of martensite in the steel as cast, FIG. 3 confirms that its annealing caused the decomposition of the martensite and the formation of a structure containing carbide dispersed in ferrite. This change in structure was obviously responsible for the reduction in hardness which was brought about by annealing, as shown in Table 4.

Figure 4:
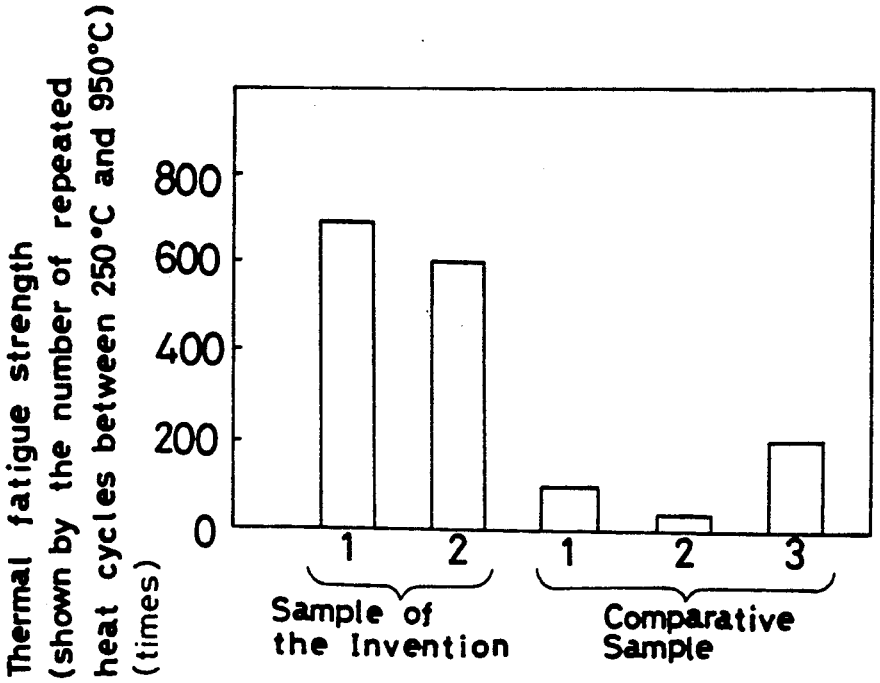
FIG. 4 is a graph comparing steels embodying this invention and comparative steels in thermal fatigue strength.

FIG. 4 shows the results of the thermal fatigue strength tests. Samples 1 and 2 of this invention could withstand a by far greater number of heating and cooling cycles without breaking than any of the Comparative Samples could. These results confirm the outstandingly high thermal fatigue strength of the steel according to this invention.

Figure 5:
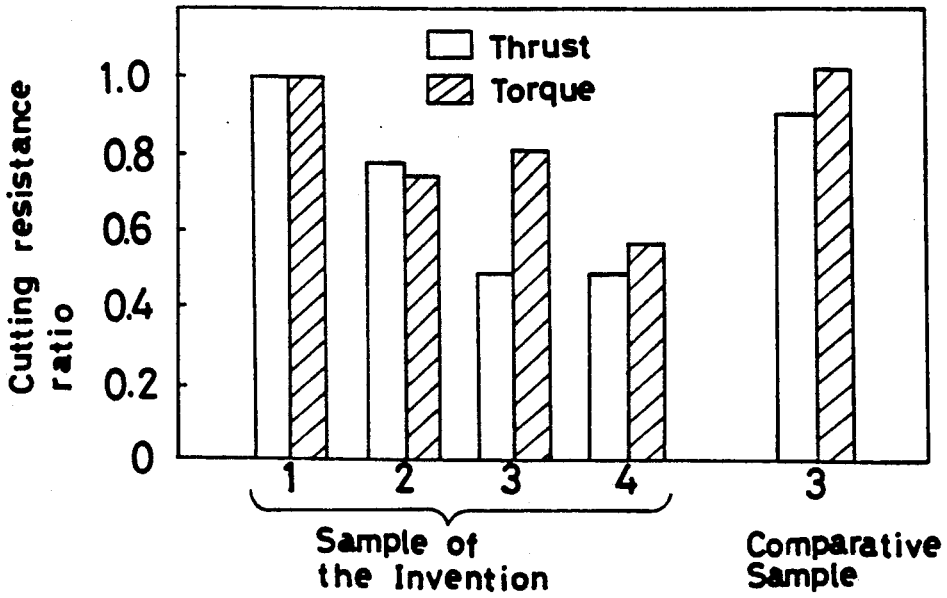
FIG. 5 is a graph comparing steels embodying this invention and comparative steel in machinability.
Figure 6:
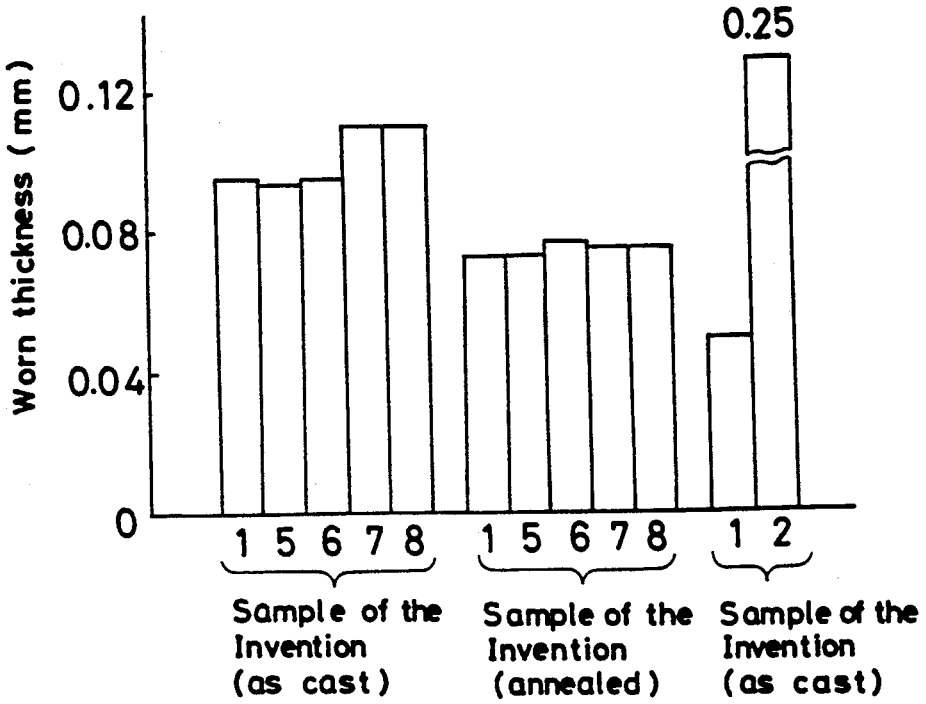
FIG. 6 is a graph comparing steels embodying this invention and other comparative materials in machinability.

FIGS. 5 and 6 show the results of the machinability tests. The tests were conducted by evaluating Samples 1 to 4 of this invention and Comparative Sample 3 for cutting resistance, while employing Samples 1 and 5 to 8 as cast and as annealed and Comparative Samples 1 and 2 as cast to determine the amount of wear on the drill. As is obvious from FIG. 5, while Sample 1 of this invention was substantially equal in machinability to Comparative Sample 3 (JIS SCH 1), greatly improved machinability was achieved by Samples 2 to 4 of this invention containing higher proportions of manganese and sulfur, and further containing or not containing tellurium, or tellurium and aluminum, as is obvious from FIG. 5. As is obvious from FIG. 6, Samples 1 and 5 to 8 of this invention as cast were by far superior in machinability to Comparative Sample 2 (Niresist), and when annealed, they showed a still higher level of machinability approaching that of Comparative Sample 1 (high-Si nodular graphite cast iron).

Table 5 shows the results of the oxidation resistance tests. From this Table 5, it is obvious that the tensile strength of the Examples 1 and 2 of the present invention is later compared not only with the Comparative Example 1 (high-Si nodular graphite cast iron) but also with the Comparative Example 3 (JIS SCH 1). Samples 1 and 2 of this invention showed very small weight losses by oxidation, as compared with any of Comparative Samples 1 to 3.

TABLE 5

| | Weight loss by oxidation ($mg/cm^3$) |
|---|---|
| Sample of the Invention | |
| 1 | 9.3 |
| 2 | 10.4 |
| Comparative Sample | |
| 1 | 180.0 |
| 2 | 180.0 |

TABLE 5-continued

| | Weight loss by oxidation ($mg/cm^3$) |
|---|---|
| 3 | 72.0 |

As explained above, according to the ferritic heat-resisting cast steel of the present invention, since it contains small amount of W, Ni and Mn and optionally elements having superior machinability such as S, Te and Al or Co and Ti, the alloy steel succeeded to obtain the increase of heat resistance without losing oxidation resistance, machinability and structural stability to contribute to obtain high output and lowering of fuel consumption of automobile engine. Further, according to the preparing method of ferritic heat-resisting cast steel of the present invention, after annealing the cast steel it becomes sufficiently softened to acquire improved machinability.

What is claimed is:

1. A ferritic heat-resisting cast steel consisting essentially of:

on a weight basis, 0.05 to 0.5% C, 1.0 to 2.0% Si, less than 0.6% Mn, less than 0.04% P, less than 0.04% S, less than 0.5% Ni, 10 to 20% Cr, 0.1 to 1.0% V, 0.5 to 1.0% Nb, 0.08 to 0.50% Mo, less than 0.01 W and 0.01 to 0.2% Ce, the balance thereof being iron.

2. A cast steel as set forth in claim 1, further consisting essentially of 0.1 to 5.0 wt. % Co and/or 0.1 to 5.0 wt % Ti.

3. A cast steel as set forth in claim 2, further consisting essentially of 0.01 to 1.00 wt % Al.

4. A ferritic heat-resisting cast steel consisting essentially of, on a weight basis, 0.05 to 0.5% C, 1.0 to 2.0% Si, 0.1 to 1.5% Mn, less than 0.04% P, 0.01 to 0.20% S, less than 0.5% Ni, 10 to 20% Cr, 0.1 to 1.0% V, 0.5 to 1.0% Nb, 0.08 to 0.50% Mo, less than 0.01 W and 0.01 to 0.2% Ce, wherein said steel satisfies the relation $S \leqq Mn$ and is annealed at 850° to 1000° C. for the period of time of from 1 to 5 hours.

5. A cast steel as set forth in claim 4, further consisting essentially of 0.01 to 0.2 wt. % Te and/or 0.01 to 0.30 wt. % Al.

6. A ferritic heat-resisting cast steel as set forth in claim 4, further consisting essentially of 0.1 to 5.0% Co and/or 0.1 to 5.0% Ti.

7. A cast steel as set forth in claim 6, further consisting essentially of 0.01 to 1.00 wt. % Al.

8. A process for making ferritic heat-resisting cast steel which comprises casting steel having the composition as set forth in claim 1 and annealing at a temperature of 850° to 1000° C. for a period of time of from 1 to 5 hours.

9. A process for making ferritic heat-resisting cast steel which comprises casting steel having the composition as set forth in claim 4 and annealing at a temperature of 850° to 1000° C. for a period of time of from 1 to 5 hours.

* * * * *